United States Patent [19]

Kindersley

[11] 4,074,437

[45] Feb. 21, 1978

[54] DRAFTING TEMPLATE

[76] Inventor: Peter G. Kindersley, 35 Wincrest Drive, Glens Falls, N.Y. 12801

[21] Appl. No.: 742,991

[22] Filed: Nov. 18, 1976

[51] Int. Cl.[2] ..... B43L 13/02

[52] U.S. Cl. ..... 33/41 B; 33/104

[58] Field of Search ..... 33/41 R, 41 B, 42, 104, 33/108

[56] References Cited

U.S. PATENT DOCUMENTS

| | | | |
|---|---|---|---|
| D. 200,664 | 3/1965 | Kellinger et al. | D52/6 |
| 732,379 | 6/1903 | Shireman | 33/42 |
| 2,676,410 | 4/1954 | Nelson | 33/104 |
| 2,690,619 | 10/1954 | Tisch | 33/104 |

OTHER PUBLICATIONS

The Frederick Post Co. Catalog, Oct. 1920, p. 128.

*Primary Examiner*—Charles E. Phillips

*Attorney, Agent, or Firm*—Cushman, Darby & Cushman

[57] ABSTRACT

A template aid for draftsmen which makes it simple to crosshatch in section and to provide lettering guide lines. The template aid includes an equilateral polygon-shaped sheet having "*x*" straight-edged sides wherein "*x*" is an integer larger than 2, and a plurality of equilateral polygon-shaped openings formed in the sheet, each opening having "*yx*" straight-edged sides where *y* is a positive integer. The openings are disposed with respect to the sheet straight-edged sides so that for each opening there is a line perpendicular to a straight-edged side of the sheet that bisects an apex of the opening. The plurality of openings are disposed in at least one series, in each series the distance from the apex of each opening to a corresponding apex in an adjacent opening being a constant throughout the series, relative to a given straight edge of the sheet.

9 Claims, 4 Drawing Figures

10
12
14
14'
18
19
20
20a
20b
21
22
30
30a
30b
31
32
40
40a
40b
41
42

DRAFTING TEMPLATE

BACKGROUND AND SUMMARY OF THE INVENTION

The invention relates to a template aid for a draftsman which makes it simple to crosshatch and section – even to squarehatch – and to provide lettering guide lines. While many prior art structures are known for performing the general function of the present invention, such as those shown in U.S. Pat. Nos. 1,131,962, 2,674,803, and 3,142,906, (also see the Braddock-Rowe triangle, and Ames lettering instrument), it is believed that none of these prior art devices provides a drafting instrument that is as simple and inexpensive as that according to the present invention, while providing numerous different spacings of crosshatching or guide line lines as the present invention.

The drafting instrument according to the present invention comprises an equilateral polygon-shaped sheet having "$x$" straight-edged sides wherein "$x$" is an integer larger than 2, a plurality of equilateral polygon-shaped openings formed in the sheet, each opening having "$yx$" straight-edged sides wherein $y$ is a positive integer, the openings being disposed with respect to the sheet straight-edge sides so that for each opening there is a line perpendicular to a straight-edged side of the sheet that bisects an apex of the opening, and the plurality of openings disposed in at least one series, in each series the distance from the apex of each opening to a corresponding apex in an adjacent opening being a constant throughout the series, relative to a given straight edge of the sheet. The straight edges of the sheets are adapted to be disposed against a T-square or the like, and since the openings in the sheet are formed by polygons, the pencil tip is firmly and accurately located in an apex of the polygon-shaped opening, rather than in a round hole as provided in common prior art structures. By providing a number of series of openings in the sheet, and by providing different constant distances between the openings from series to series relative to each sheet straight edge, an instrument is provided which allows a large number of different spacings between lines to be drawn therewith, which different spacings may be selected merely by simply turning the sheet from one straight edge to another. No moving parts are provided to achieve the great flexibility in crosshatch line distances according to the present invention.

According to a preferred embodiment of the present invention, the sheet is triangular, and the openings formed in the sheet also are triangular, at least two series of openings being provided, and therefore six constant distances being provided, each distance being different.

It is the primary object of the present invention to provide a simple drafting instrument for drawing, hatching and lettering lines of constant readily selectable different spacings without utilizing any moving parts. This and other objects of the invention will become clear from an inspection of the detailed description of the invention, and from the appended claims.

DETAILED DESCRIPTION OF THE INVENTION

Figures 1, 2:
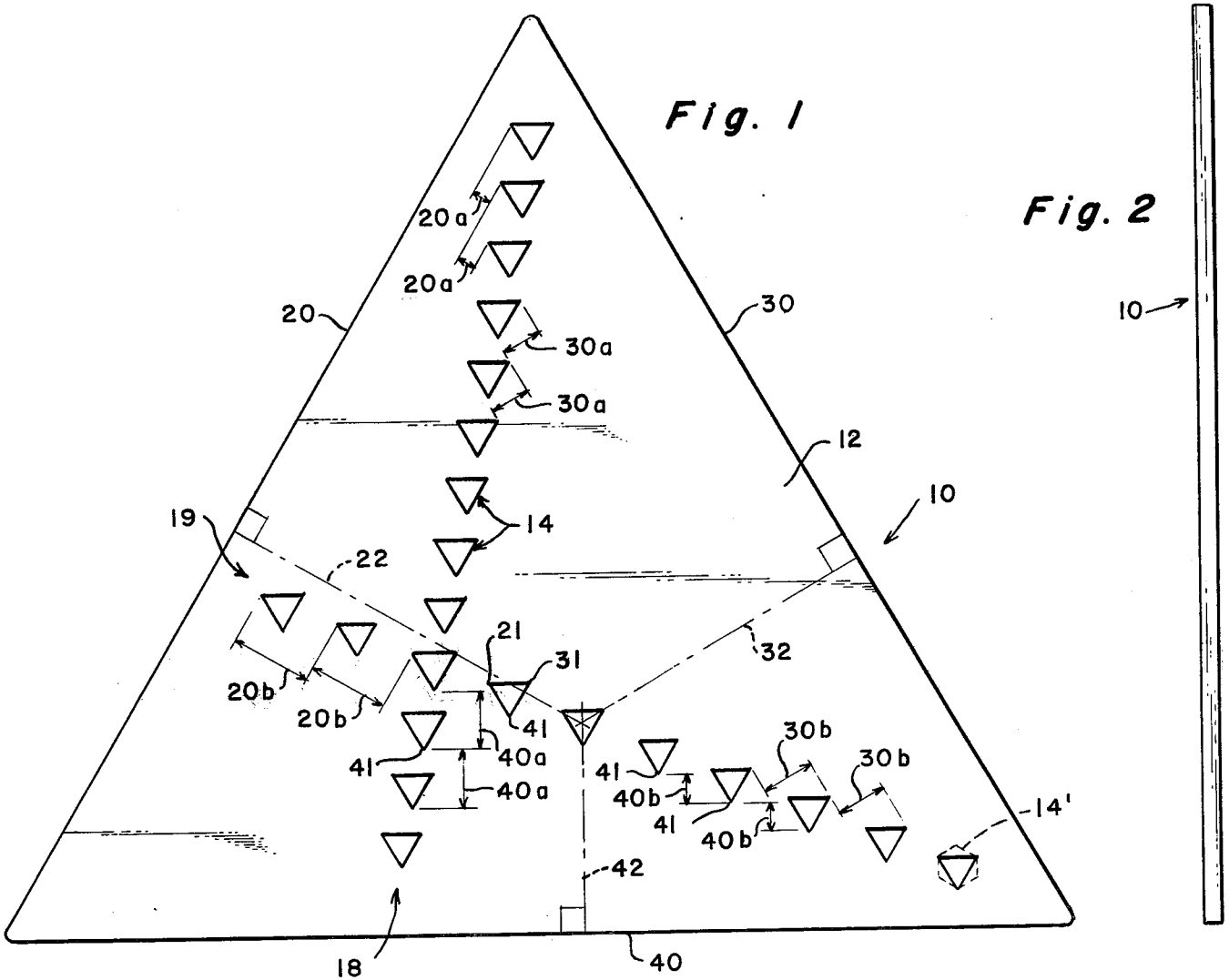
FIG. 1 is a top plan view of an exemplary drafting instrument according to the present invention.
FIG. 2 is a side view of the instrument shown in FIG. 1.

A drafting instrument according to the present invention is shown generally at 10 in FIG. 1. The instrument 10 primarily comprises a sheet 12 having an equilateral polygon shape and having a plurality of equilateral polygon-shaped openings 14 formed therein. The sheet 12 may be formed of any suitable material, such as a transparent plastic, and has a thickness 16 (see FIG. 2) which makes it compatible for use with conventional T-squares and other drafting instruments. For example, the distance 16 may be between 0.05 and 0.062 inches.

The equilateral polygon-shaped sheet 12 has $x$ straight edged sides, wherein $x$ is an integer larger than 2. For the embodiment of the invention shown in FIG. 1 – a triangular-shaped sheet – three straight-edged sheet sides are provided, 20, 30 and 40. Each of the plurality of equilateral polygonshaped openings 14 formed in the sheet 12 has $yx$ straight-edged sides wherein $y$ is a positive integer. Generally, the openings 14 will have the same polygon shape as the sheet 12. For instance, for the embodiment shown in FIG. 1 the triangular sheet 12 has triangular-shaped openings 14 formed therein, although hexagon-shaped openings 14' could be provided instead ($x = 3$ and $y = 2$ when openings such as 14' are provided for a sheet 12 as shown in FIG. 1).

The openings 14 are disposed with respect to the sheet straight-edged sides 20, 30, and 40 so that for each opening 14 there is a line (22, 32, 42) perpendicular to a straight-edged side of the sheet that bisects an apex (21, 31, 41) of the opening. As shown in FIG. 1 for one of the openings 14, a line 22 perpendicular to edge 20 bisects apex 21 of the opening, a line 32 perpendicular to edge 30 of sheet 12 bisects apex 31, and a line 42 perpendicular to edge 40 of sheet 12 bisects apex 41. Similarly with all the other openings 14 of the sheet 12. When the openings 14 are disposed in this manner, apices are provided for firmly, accurately locating a pencil tip for drawing straight lines no matter which of the edges 20, 30, and 40 are provided adjacent a T-square or the like. For instance, apices 41 are provided associated with edge 40 of sheet 12 for providing secure, accurate location of a pencil tip when the edge 40 is disposed against the T-square or the like.

The plurality of openings 14 are disposed in at least one series of openings (18, 19). In each series of openings (18, 19), the distance from the apex of each opening to a corresponding apex in an adjacent opening is a constant throughout the series relative to a given straight edge of the sheet. For instance, for the series of openings 18 the distance **40*a* from the apex 41 of each opening 14 in series 18 to a corresponding apex 41 in an adjacent opening 14 in series 18 is a constant throughout the series, in this case the distances being relative to the straight edge 40 of the sheet 12. Similarly for the series 19 relative to the edge 40, the distances 40*b* between the apices 41 of openings 14 in series 19 being constant. Preferably, at least two series 18, 19 are provided in the sheet 12, and preferably the constant distance from the apex of each opening 14 to a corresponding apex in an adjacent opening 14 is different for each series relative to a given straight edge of the sheet. That is, the distances 20***a*, 20*b* corresponding to series 18, and 19 respectively relative to edge 20 are different, and similarly distance 30*a* is not equal to distance 30*b*, and distance 40*a* is not equal to distance 40*b*. Ideally, none of these constant distances are the same, so that for the instrument 10 shown in FIG. 1, 20*a* would not equal 20*b* would not equal 30*a* would not equal 30*b* would not equal 40*a* would not equal 40*b*. Thus, by merely providing two series of openings in a triangular sheet 12, six different spacings are provided for hatching or lettering lines.

Figure 3:
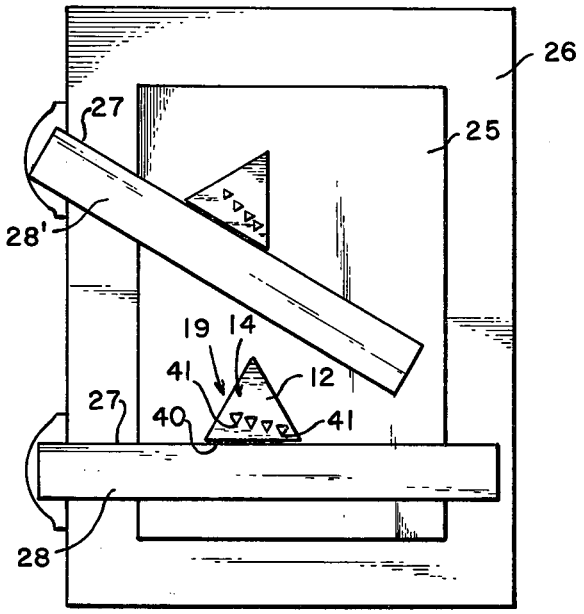
FIG. 3 is a diagrammatic top view showing instruments such as shown in FIG. 1 in use.

The basic structure of the invention having been disclosed, a particular mode of operation thereof will be set forth with particular reference to FIG. 3. The instrument 12 is placed over a sheet 25 to be hatched or lettered, the sheet 25 being disposed on a conventional drafting board 26. A particular edge of the sheet 12 having openings 14 spaced a desired distance is selected and placed in engagement with a straight edge 27, such as a straight edge of a conventional T-square 28. For the instrument 12 shown in FIG. 3, the edge 40 has been placed against straight edge 27. In order to then draw parallel lines that are spaced a constant distance from each other, without moving the T-square 28, the pencil tip is inserted into an apex 41 of an opening 14 in sheet 12 and the sheet 12 is moved along the straight edge 27, a straight line being drawn by the pencil tip in apex 41 during the movement of the sheet 12 relative to the straight edge 27. The straight edge 41 is then moved to an apex 41 of the next opening 14 of the series 19 of openings 14 and again the sheet 12 is moved relative to the straight edge 27, whereby another line is drawn parallel to the first line. Of course, adjacent openings 14 in a series 19 need not be used, but rather every other opening may be used wherein a constant distance twice 40*b* is desired rather than the constant distance 40*b*, between the parallel lines to be drawn. The straight edge 27 may be oriented in any manner with respect to the paper 25, such as shown in FIG. 3 with respect to T-square 28'. Thus, any type of hatching (including square hatching) and/or lettering guide lines may be provided. The distances 20*a*, 20*b*, etc. of the openings 14 in the sheet 12 may be selected to provide lettering guides for any conventionally sized letters or the like.

Figure 4:
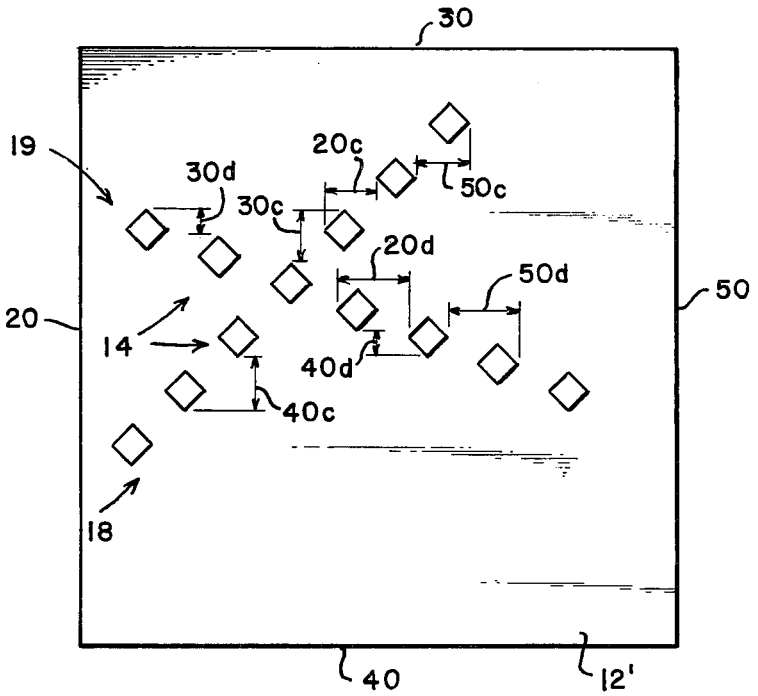
FIG. 4 is a top plan view of a modified form of the drafting instrument according to the present invention.

While the instrument 10 has been shown in FIG. 1 as an equilateral triangle, the sheet 12 may assume any equilateral polygon shape, such as the square shown in FIG. 4. The openings 14 formed in the square sheet 12' shown in FIG. 4 are then of course also square in shape (or octagonal, etc.) and have the same relative relationship with respect to the sheet 12' described above relative to the sheet 12. As shown in FIG. 4, the spacings 20*c*, 20*d*, 30*c*, 30*d*, 40*c*, 40*d*, and 50*c*, 50*d* would be provided for the series of openings 18, 19. It is noted that since the distances 20*c* and 50*c* would be the same, for a polygon sheet having an even number of sides not as much variety of the distances would be provided for a given number and series of openings as in a polygon sheet having an odd number of sides. Therefore, it is preferably to form the sheet 12 such that $x$ is an odd integer (i.e. 3 as shown in FIG. 1).

It will thus be seen that according to the present invention a drafting instrument has been provided which is useful for drawing hatching and lettering guide lines spaced constant distances apart, which instrument is simple, has no moving parts, is low cost, and provides a wide selection of spacings to choose from. While the invention has been herein shown and described in what is presently conceived to be the most preferred and practical embodiment of the invention, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A drafting instrument comprising an equilateral polygon-shaped sheet having $x$ straight-edged sides wherein $x$ is an integer larger than 2, a plurality of equilateral polygon-shaped openings formed in said sheet, each opening having $yx$ straight-edged sides wherein $y$ is a positive integer, said openings being disposed with respect to said sheet straight-edged sides so that for each opening there is a line perpendicular to each straight-edge side of said sheet that bisects an apex of said opening, and said plurality of openings disposed in at least one series, in each series the distance from the apex of each opening to a corresponding apex in an adjacent opening being a constant throughout the series, relative to a given straight edge of said sheet, and a line connecting the corresponding apeces in a series intersecting each line extending perpendicular to the midpoint of each said sheet sides, and intersecting a line bisecting each corner of said sheet.

2. A drafting instrument as recited in claim 1 wherein at least two series of said openings are provided in said sheet, and wherein the constant distance from the apex of each opening to a corresponding apex in an adjacent opening is different for each series relative to a given straight edge of said sheet.

3. A drafting instrument as recited in claim 2 wherein said constant distances are different for each series relative to each different edge of said sheet.

4. A drafting instrument as recited in claim 3 wherein no two of said constant distances are the same.

5. A drafting instrument as recited in claim 1 wherein said sheet is triangular and wherein said openings are triangular.

6. A drafting instrument as recited in claim 5 wherein two series of openings are provided.

7. A drafting instrument as recited in claim 1 wherein $x$ is an odd integer.

8. A drafting instrument as recited in claim 1 wherein $y = 1$.

9. A drafting instrument as recited in claim 1 wherein the constant distance between the corresponding apeces is different relative to each given straight edge of said sheet.

* * * * *